US009453697B2

(12) United States Patent
Williams

(10) Patent No.: US 9,453,697 B2
(45) Date of Patent: Sep. 27, 2016

(54) FIREARM CLEANING KIT

(71) Applicant: Nicholas Williams, Naples, FL (US)

(72) Inventor: Nicholas Williams, Naples, FL (US)

(73) Assignee: The Otis Patent Trust, Lyons Falls, NY (US)

( * ) Notice: Subject to any disclaimer, the term of this patent is extended or adjusted under 35 U.S.C. 154(b) by 149 days.

(21) Appl. No.: 14/144,027

(22) Filed: Dec. 30, 2013

(65) Prior Publication Data

US 2014/0110285 A1 Apr. 24, 2014

Related U.S. Application Data

(63) Continuation of application No. 13/566,504, filed on Aug. 3, 2012, now Pat. No. 8,616,367.

(60) Provisional application No. 61/515,653, filed on Aug. 5, 2011.

(51) Int. Cl.

| | |
|---|---|
| ***B25H 3/00*** | (2006.01) |
| ***F41A 29/02*** | (2006.01) |
| ***B65D 77/22*** | (2006.01) |
| ***A45C 11/00*** | (2006.01) |

(52) U.S. Cl.

CPC ..... *F41A 29/02* (2013.01); *A45C 11/00* (2013.01); *B65D 77/22* (2013.01)

(58) Field of Classification Search

USPC ..... 206/317, 372, 373

See application file for complete search history.

(56) References Cited

U.S. PATENT DOCUMENTS

| | | | | |
|---|---|---|---|---|
| 1,149,690 | A * | 8/1915 | Saffold | F41C 33/06 206/317 |
| 3,696,850 | A * | 10/1972 | Rosenblum | A45C 7/0086 190/108 |
| 4,253,716 | A * | 3/1981 | Turner, Jr. | B62B 1/264 206/373 |
| 4,901,464 | A | 2/1990 | Banoun | |
| 6,230,771 | B1 * | 5/2001 | Hellenbrand | A45C 3/00 150/111 |
| 6,619,447 | B1 * | 9/2003 | Garcia, III | A45C 7/0086 150/111 |
| 7,841,472 | B1 * | 11/2010 | Williams | F41A 29/02 206/373 |
| 2002/0104725 | A1 * | 8/2002 | Dexheimer | A45C 5/14 190/108 |
| 2006/0102677 | A1 * | 5/2006 | Nassanian | A45C 13/02 224/652 |
| 2006/0180487 | A1 * | 8/2006 | Chan | A45C 7/0095 206/373 |
| 2006/0180624 | A1 * | 8/2006 | Sadow | A45C 7/009 224/582 |
| 2007/0129269 | A1 | 6/2007 | Arce et al. | |
| 2008/0011567 | A1 * | 1/2008 | Hammond | A45C 7/009 190/108 |
| 2009/0260180 | A1 | 10/2009 | Meredith et al. | |
| 2011/0174679 | A1 | 7/2011 | Williams | |
| 2012/0090215 | A1 * | 4/2012 | Buie, II | F41A 29/00 42/95 |

* cited by examiner

*Primary Examiner* — Jacob K Ackun
(74) *Attorney, Agent, or Firm* — Harris Beach PLLC

(57) ABSTRACT

A firearm cleaning kit includes a base cleaning kit, at least one module attachment element affixed to an exterior portion of the base cleaning kit, and a first modular kit case adapted for storing at least one specialized cleaning implement. The base cleaning kit is adapted to store cleaning implements for a first class of firearm. The base cleaning kit includes a tool insert secured to an interior region of the case, and a first firearm cleaning tool secured within the tool insert. The first modular kit case is sized smaller than the base cleaning kit, and includes a first external fastening element adapted for releasable securement to the at least one module attachment element of the base cleaning kit. The specialized cleaning implement not included in the base cleaning kit.

13 Claims, 15 Drawing Sheets

FIREARM CLEANING KIT

CROSS REFERENCE TO RELATED APPLICATIONS

Reference is made to and this application claims priority from and the benefit of U.S. Provisional Application Ser. No. 61/515,653, filed Aug. 5, 2011, entitled "MODULAR FIREARM CLEANING KIT CASE," which application is incorporated herein in its entirety by reference. This is a continuation of the invention described in U.S. patent application Ser. No. 13/566,504, filed Aug. 3, 2012 by the same inventors herein, titled "MODULAR FIREARM CLEANING KIT CASE." The invention described in U.S. patent application Ser. No. 13/566,504 is assigned to the assignee hereof.

FIELD OF THE INVENTION

This invention relates generally to the field of firearm cleaning kits, and more particularly to a modular kit case adapted for releasable securement to a base cleaning kit case.

BACKGROUND OF THE INVENTION

Proper cleaning of a firearm after use is essential to ensuring the firearm retains its accuracy, safety, and reliability. With each firing, the breech and bore of a firearm accumulate residue such as powder, priming compound, and copper fragments from ammunition casings. In addition, environmental elements such dirt, snow, and moisture can accumulate in the bore, causing further fouling. Fouling and debris may also accumulate in the firearm's action due to its design, or improper maintenance. Failure to remove the residue and debris results in a decrease in the firearm's accuracy and reliability, and may even pose a safety hazard to the operator. Therefore, proper cleaning is one of the most important elements of firearm ownership.

Civilians who shoot and clean firearms often fashion their own tools to aide in the cleaning process. However, these homemade cleaning tools are generally not portable or lightweight. When cleaning a firearm, components or cleaning tools may be set aside during the cleaning process and, due to their small size, may be misplaced or lost. Therefore, civilians have a need for a lightweight and compact firearm cleaning kit that stores cleaning tools and provides additional storage capability.

Military personnel need to be able to clean their weapons in the field, preferably immediately after shooting so that their firearm is ready for use at all times. An important aspect of the cleaning process is that the cleaning kit be compact and lightweight, organized, and able to store firearm components or spare tools and cleaning supplies. Therefore, military personnel also need for a lightweight and compact firearm cleaning kit that stores cleaning tools and provides additional storage capability for the cleaning of military weapons.

To answer the need for portable, compact, and lightweight storage cases for firearm cleaning materials and tools, many different types of firearm cleaning kits have been designed for military and consumer use. Specialized, compact cleaning kits have been custom-designed to store the precise tools and components needed to thoroughly clean a particular firearm. For example, firearm cleaning tool kits have been designed to store specific cleaning tools such as brushes, picks, scrapers, and rods.

SUMMARY OF THE INVENTION

As the complexity of firearms increases, and additional accessories such as advanced optics become more commonplace, there is a need for specialized implements to complement the firearms and accessories. This need for specialized implements is compounded when the user has several firearms at their disposal, as may be the case for a soldier in an infantry squad. As specialized implements are continually added to a cleaning kit, the compactness of the kit suffers. Further, multiple firearms may require multiple cleaning kits. One solution is to scavenge cleaning implements and cram them into an existing or home-made case, but this approach is not favored due to the likelihood of losing implements or, worse, packing the wrong implements.

Disclosed herein is a firearm cleaning kit that alleviates the problems noted in the art. In one aspect, the firearm cleaning kit includes a case comprising a first side and a second side joined along a fold line, and a fastener for joining together the first and second side of the case. A tool-holding insert is secured to an interior region of the case. The tool-holding insert includes a plurality of tool cavities and a first firearm cleaning implement removably secured in one of the tool cavities. The first firearm cleaning implement is adapted for cleaning a first type of firearm. The firearm cleaning kit further includes a cable reel adapted to store a coiled flexible cable cleaning rod.

In one embodiment, the cable reel includes a circular flat base on which the coiled flexible cable cleaning rod rests, and a plurality of capture elements disposed around the outer perimeter of the base. The capture elements each include a capture cavity to secure the coiled flexible cable cleaning rod.

The capture element may include a back spine extending transversely from the base, and a cap portion extending transversely from the spine.

In another aspect of the invention, a firearm cleaning kit includes a case comprising a first side and a second side joined along a fold line, and a fastener for joining together the first and second side of the case. The firearm cleaning kit further includes a tool-holding insert secured to an interior region of the case. The tool-holding insert includes a plurality of tool cavities and a first firearm cleaning implement removably secured in one of the tool cavities. The firearm cleaning kit further includes a hardened implement protective shell sized to fully surround and enclose by friction fit at least a portion of a second firearm cleaning implement.

In one embodiment, the second firearm cleaning implement is a brush having a plurality of bristles, and the protective shell fully surrounds and encloses the bristles by friction fit.

The implement protective shell may be formed of hardened plastic.

In another aspect of the invention, a firearm cleaning kit includes a base cleaning kit, at least one module attachment element affixed to an exterior portion of the base cleaning kit, and a first modular kit case adapted for storing at least one specialized cleaning implement. The base cleaning kit is adapted to store cleaning implements for a first class of firearm. The base cleaning kit includes a case having a first side and a second side joined along a fold line, a fastener for joining together the first and second side of the case, a tool insert secured to an interior region of the case, and a first firearm cleaning tool secured within the tool insert. The first modular kit case is sized smaller than the base cleaning kit, and includes a first external fastening element adapted for releasable securement to the at least one module attachment element of the base cleaning kit. The specialized cleaning implement not included in the base cleaning kit.

In one embodiment, the firearm cleaning kit further includes a second modular kit case different from the first modular kit case. The second modular kit case includes a second external fastening element adapted for releasable securement to a second module attachment element on the base cleaning kit.

The second external fastening element may be identical to the first external fastening element of the first modular kit case.

In another embodiment, the specialized cleaning implement of the first modular kit case is adapted for a second class of firearm.

In another embodiment, the specialized cleaning implement of the first modular kit case comprises a cleaner for optical surfaces of a firearm.

In another embodiment, the first modular kit case is a drop pouch.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
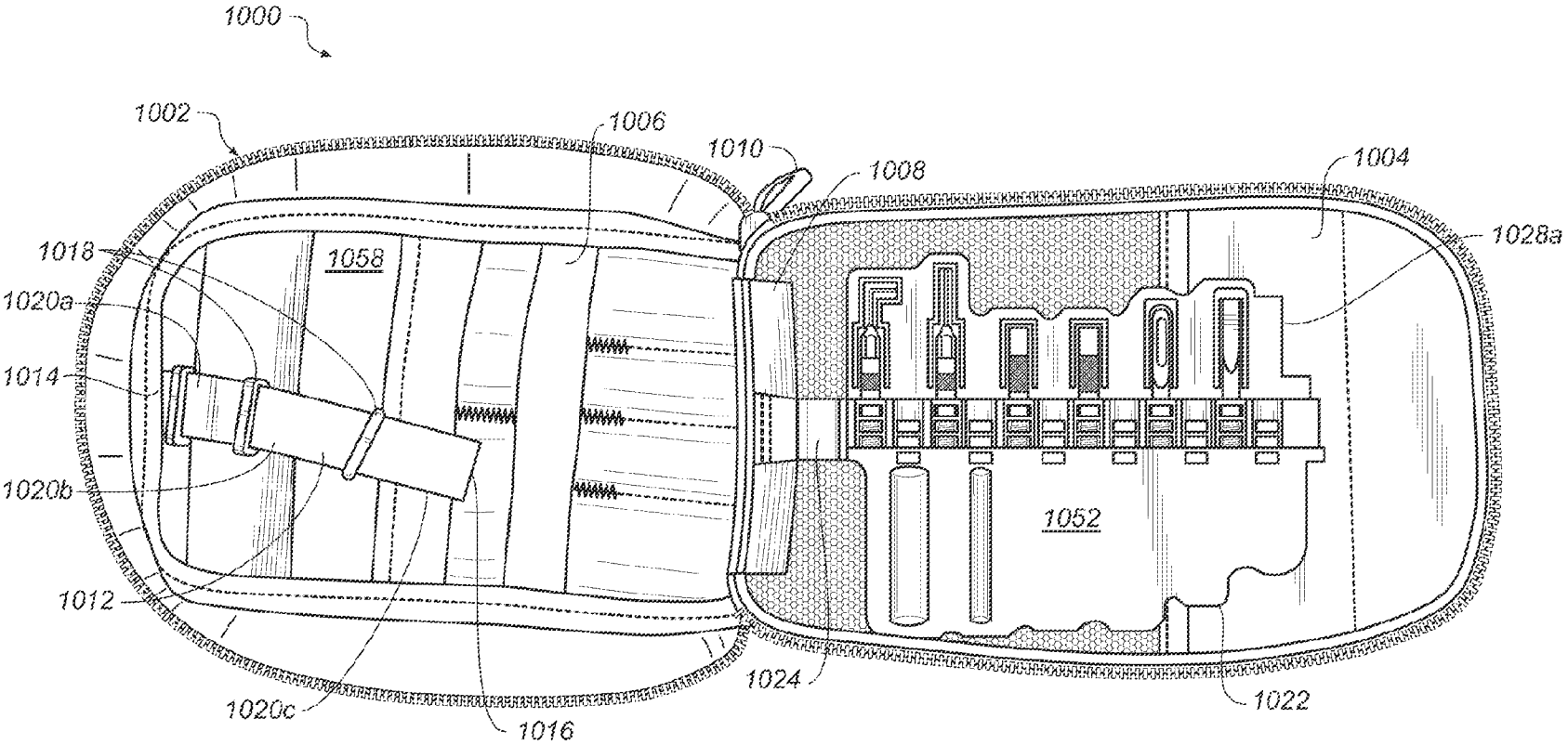
FIG. 1 is a perspective view of the inner portions of a firearm cleaning kit according to an embodiment of the invention.

Referring to FIG. 1 of the drawings, a firearm cleaning kit 1000 includes case 1002 having a first side 1004 and a second side 1006 separated by a fold line 1008. The fold line 1008 joins the first side 1004 to the second side 1006, allowing the two to be folded up in a clamshell-type arrangement. In the embodiment shown, the case 1002 is generally rectangular in shape, but any shape that permits the first side 1004 and the second side 1006 to be folded together in clamshell fashion is suitable. For example, the case 1002 could be circular or oval in shape. The case 1002 may be made from a soft, durable fabric, or may be a rigid, hard shell construction if increased toughness is required. In the embodiment shown, the case 1002 is constructed of nylon fabric to allow some compression. In one example, the case 1002 is made out of nylon with a special coating for low infrared (IR) reflectivity to reduce how it might stand out if an enemy is using night vision equipment.

The kit 1000 further includes a fastener 1010 to secure the first side 1004 to the second side 1006 when the case 1002 is in the closed position. The fastener 1010 in the disclosed embodiment is a zipper, configured to zip along three sides of the case 1002. Other fastener configurations are possible. For example, the fastener 1010 may be one or more snaps, hook and loop strips such as VELCRO® brand fasteners, or ties. The fastener 1010 in the preferred embodiment is a silent zipper due to its strength, ease of use, and quiet operation.

The firearm cleaning kit 1000 may further include a length of material formed into a closed loop, hereinafter referred to as loop 1012. The loop 1012 is affixed to the case 1002 at a fixed end 1014, leaving a free end 1016 distal to the fixed end. The width of the material is substantially greater than the material thickness, so as to aide in forming a storage compartment, as will be discussed below. In the disclosed embodiment, the material is elastic, approximately 0.75 inches in width, and approximately 0.045 inches thick. The length of the material is such that when doubled over to form the loop, the loop nests into the case 1002. The loop 1012 may be fixed to the case 1002 at any convenient location. In the disclosed example, the loop 1012 is affixed to an interior region of the case 1002. However, the loop 1012 may alternatively be affixed to the fold line 1008, or the exterior of the case.

A divider piece 1018 has a single slot therethrough. The slot width is slightly greater than the width of the elastic material. In the disclosed embodiment, the width of the slot is approximately 0.80 inches. The slot height is dimensioned to be no more than twice the thickness of material. In the disclosed embodiment, the height of the slot is approximately 0.08 inches.

The divider piece 1018, coupled with a portion of the loop 1012, forms an adjustable storage compartment 1020. FIG. 1 depicts a plurality of storage compartments 1020*a*-1020*c*. The storage compartment 1020 is formed by inserting the free end 1016 of the loop 1012 through the slot in the divider piece 1018, and sliding the divider piece along the length of the loop 1012 until the desired width is achieved. Since the width of the slot is slightly larger than the width of the elastic material, and the slot height is no more than twice the thickness of material, the doubled-over thickness of the material forming the loop 1012 causes a slight friction fit in the slot. In this manner, the divider piece 1018 slides along the length of the loop 1012 with a small amount of force, e.g., greater than the friction force, but is held in place when the sliding force is released. By virtue of this configuration, the width of the storage compartment 1020 is both adjustable and self-locking. In the preferred embodiment, the doubled-over thickness of material is approximately 0.09 inches, or 0.01 inches greater than the height of the slot. In order to insert the loop 1012 through the slot, the elastic material must be stretched to decrease its thickness.

The firearm cleaning kit 1000 further includes at least one tool-holding insert 1022 secured to the interior of the case 1002 by an attachment element 1024. In one example, the attachment element 1024 is secured to the fold line 1008. The attachment element 1024 may permanently secure the tool-holding insert 1022 to the case 1002 or, as disclosed herein, the attachment element 1024 may provide a means to release the tool-holding insert 1022 from the case.

Figure 2:
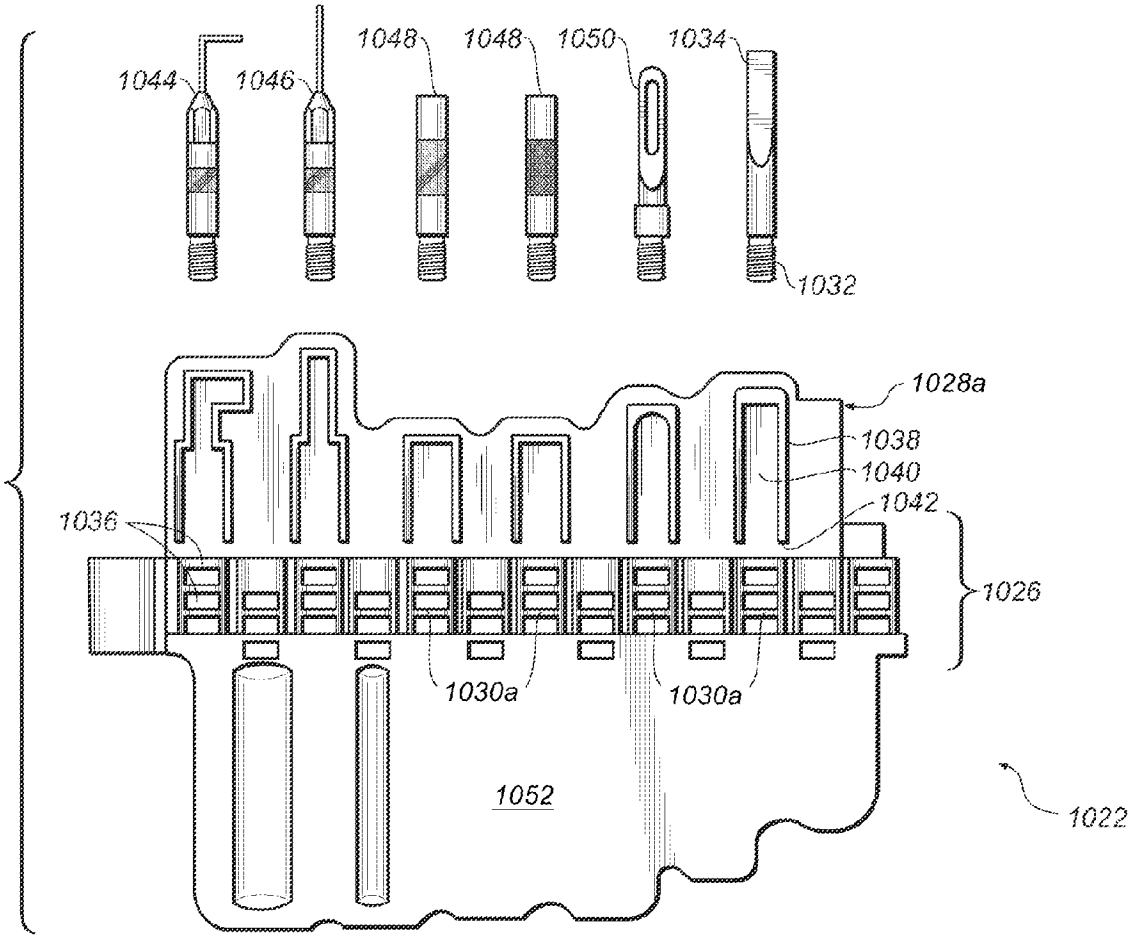
FIG. 2 is a perspective view of the front face of the tool-holding insert shown in FIG. 1.

Referring now to FIG. 2 of the drawings, the tool-holding insert 1022 is shown in greater detail, detached from the case 1002. The tool-holding insert 1022 includes a base portion 1026 joined to a flexible back plate 1028*a*. The base portion 1026 includes a tool base cavity 1030 configured to accept the shank 1032 of a firearm cleaning tool 1034. In the disclosed embodiment, the base portion 1026 may include a plurality of slots 1036. The slots 1036 are primarily to prevent air from becoming entrapped in the tool base cavity 1030 during molding, or when the firearm cleaning tool 1034 is inserted into the cavity. The tool base cavity 1030 may be sized to snugly accept the firearm cleaning tool 1034 to prevent the tool from slipping out.

The flexible back plate 1028*a* includes a raised wall 1038 defining an enclosure 1040. The raised wall 1038 is shaped to ensconce and protect the particular type of cleaning tool being stored. For example, the cleaning tool 1034 may be a scraper. The raised wall 1038 will form a generally rectangular shape, as illustrated. In other examples, the cleaning tool 1034 may be a right-angle pick, and the raised wall 1038 will form an L-shaped enclosure 1040. The possible shapes of the raised wall 1038 are as varied as the types of tools being stored, as will be described in more detail below.

To provide flexibility, the tool-holding insert 1022 may comprise a rubber compound such as a thermoplastic elastomer (TPE). Depending upon the choice of material, the tool-holding insert 1022 may be injection molded to form a unitary, one-piece construction. The raised wall 1038 and tool tip enclosure 1040 are aligned with the tool base cavity 1030 to provide a unitary holding structure. In one embodiment, the raised wall 1038 is formed integral with tool base cavity 1030. In another embodiment, a relief 1042 may be provided between the raised wall 1038 and the tool base cavity 1030. The relief 1042 allows the flexible back plate 1028*a* to deflect a greater degree during replacement and removal of tools.

Still referring to FIG. 2, the tool-holding insert 1022 may further include a plurality of tool base cavities 1030 aligned along the base portion 1026 to hold respective cleaning tools 1034 therein. In the illustrated embodiment, the cavities 1030 are identically sized because the shank 1032 of each tool is similar. As shown, the tool-holding insert 1022 is adapted to secure a variety of firearm cleaning tools such as a right-angle pick 1044, a straight pick 1046, a centerpiece 1048, and a slotted tip 1050.

Figure 3:
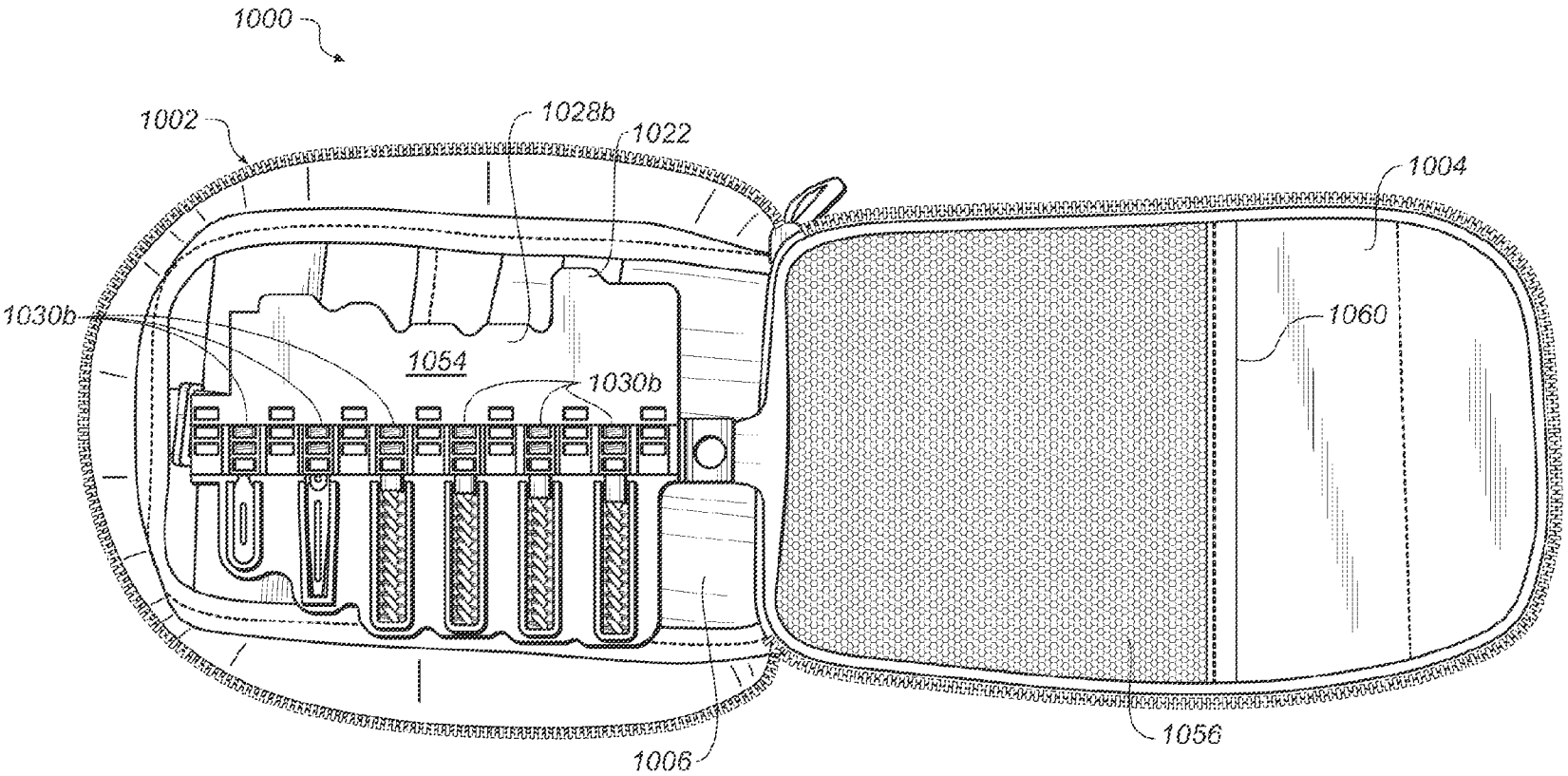
FIG. 3 is another perspective view of the inner portions of a firearm cleaning kit shown in FIG. 1.
Figure 4:
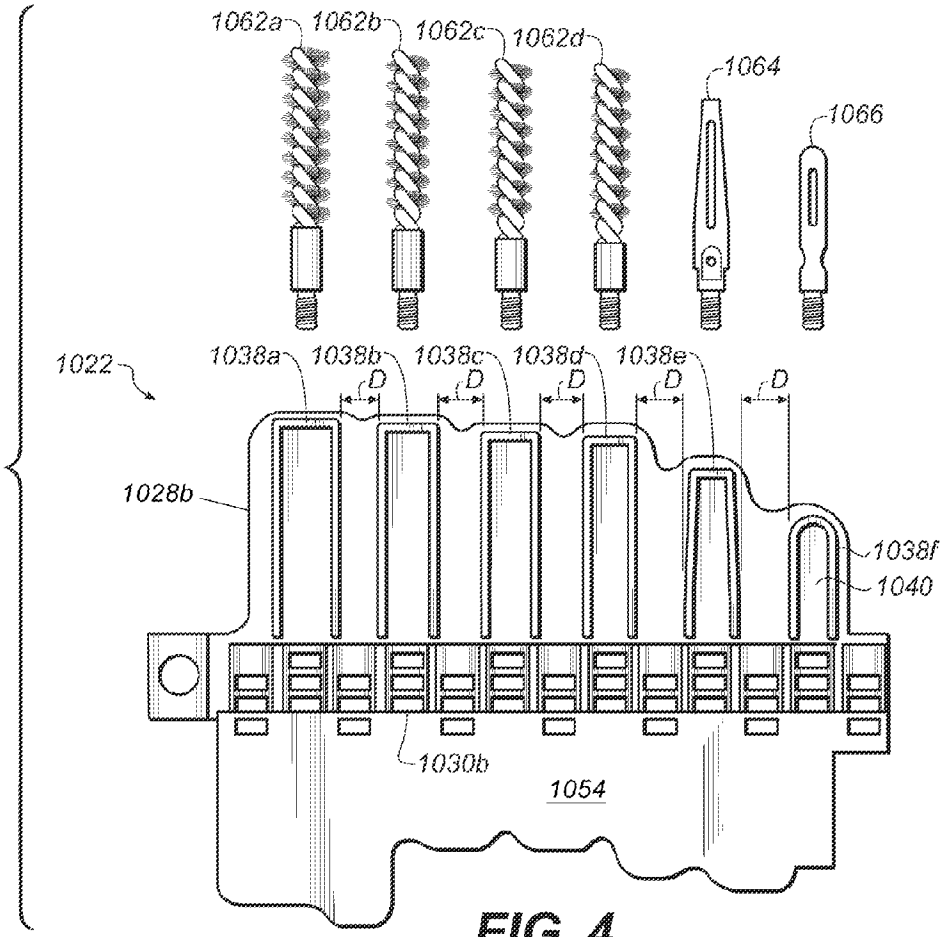
FIG. 4 is a perspective view of the back face of the tool-holding insert shown in FIG. 1.

Referring to FIGS. 1-4, in some embodiments the firearm cleaning kit 1000 includes a tool-holding insert 1022 that is double-sided to provide additional tool storage in a compact space. FIGS. 1 and 2 illustrates a first face 1052 of the tool-holding insert 1022, and FIGS. 3 and 4 illustrates a second face 1054 of the tool-holding insert. The first face 1052 and the second face 1054 include a plurality of tool base cavities 1030*a* and 1030*b*, respectively, as well as flexible back plates 1028*a* and 1028*b*. As can be seen with reference to FIG. 1, the smooth planar surface below the tool base cavities 1030*a* forms the back side of the flexible back plate 1028*b* on the second face 1054 (FIG. 3).

As best seen in FIG. 3 with the tool-holding insert 1022 moved out of the way, the case 1002 may include a first interior region 1056 defined by the first side 1004, and a second interior region 1058 defined by the second side 1006. A pocket 1060 sewn into the first interior region 1056 and/or the second interior region 1058 of case 1002 holds cleaning materials, such as a flexible cleaning rod and bore patches (not shown).

Referring to FIG. 4, the second face 1054 of the tool-holding insert 1022 is shown in greater detail, detached from the case. The second face 1054 of the tool-holding insert 1022 includes a plurality of tool base cavities 1030*b* and corresponding raised walls 1038 *a-f*. The raised walls 1038 *a-f* are spaced a distance D apart from each other, for example. In one embodiment, the distance D is sufficient to allow the tool base cavities 1030*a* and 1030*b* to be arranged in an alternating pattern, such that the distance D on one side forms the back side of the raised wall 1038 and tool tip enclosure 1040 on the other side. In the disclosed embodiment, the second face 1054 of the tool-holding insert 1022 is adapted to secure a variety of firearm cleaning tools such as bore cleaning brush 1062*a*-1062*d*, an angled pick 1064, and a second slotted tip 1066.

Figure 5:
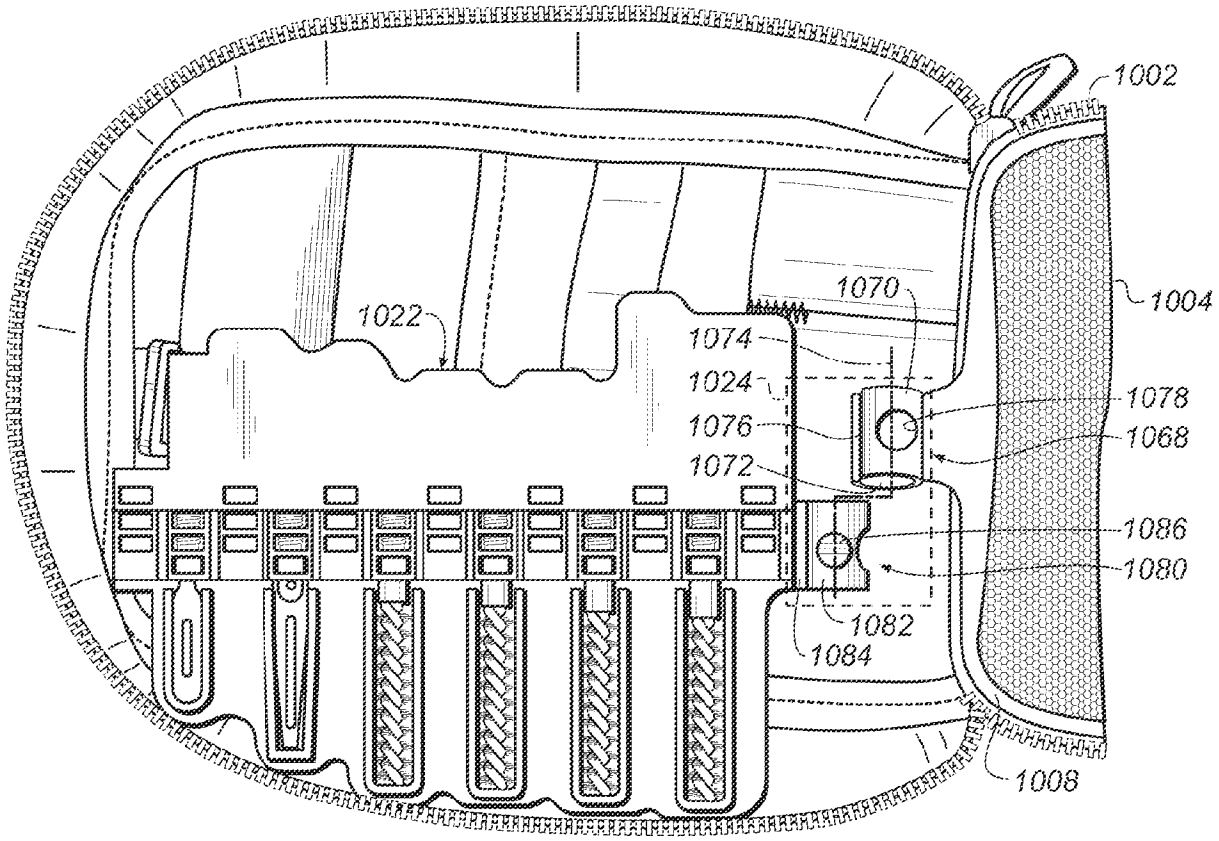
FIG. 5 is an exemplary embodiment of the attachment element shown in FIG. 1.

Referring now to FIG. 5, the attachment element 1024 is shown with the tool-holding insert 1022 detached from the case 1002. A fixed portion 1068 of the attachment element 1024 is sewn or otherwise permanently secured to the fold line 1008 on the interior of the case 1002. In the disclosed embodiment, the fixed portion 1068 includes a thin-wall clamp 1070 defining a bore 1072 along a longitudinal axis 1074 therethrough. The axis 1074 is oriented generally along the fold line 1008. The clamp 1070 further includes a slot 1076 oriented along the longitudinal axis 1074 and an engagement recess 1078 aligned perpendicular to the longitudinal axis.

A detachable portion 1080 of the attachment element 1024 includes a cylindrical element 1082 joined to the tool-holding insert 1022 by a stem 1084. The cylindrical element 1082 includes a raised detent 1086 on the cylindrical surface. To secure the tool-holding insert 1022 to the case 1002, the stem 1084 of the cylindrical element 1082 is aligned with the slot 1076 on the fixed portion 1068 of the attachment element 1024, which also aligns the raised detent 1086 with the engagement recess 1078. The cylindrical element 1082 slideably engages the bore 1072 until the raised detent 1086 snaps into the engagement recess 1078.

The disclosed arrangement is only one example of an attachment element 1024. In other arrangements, the attachment element 1024 may comprise snaps, VELCRO® brand fasteners, or the like. In other embodiments, the case 1002 may not include the attachment element 1024, such when the tool-holding insert 1022 is permanently fixed to the case 1002, for example by sewing.

Figure 6:
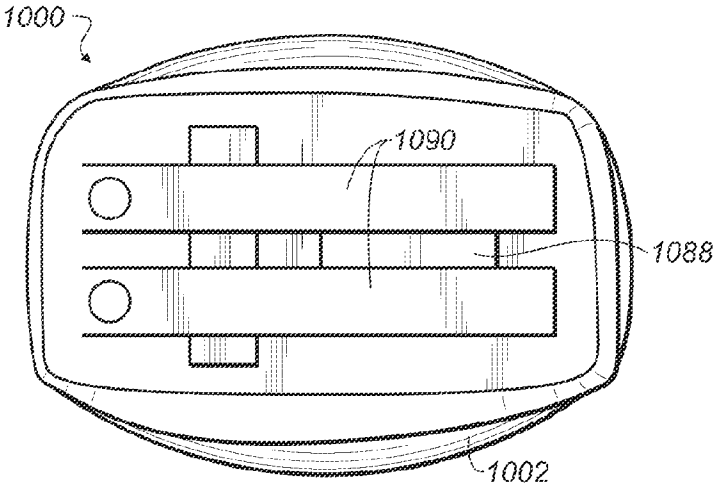
FIG. 6 is a perspective exterior view of a firearm cleaning kit shown in FIG. 1.

Referring now to FIG. 6, the firearm cleaning kit 1000 may further include a belt attachment 1088 affixed to the exterior of the case 1002. In one embodiment, the belt attachment 1088 comprises a rugged strip of nylon fabric sewn at each end to the case 1002, thereby forming a loop through which a belt (not shown) may be passed. In one example (not shown), a piece of heavy duty fabric is secured through the loop to which clips are adapted for a modular lightweight load-carrying equipment (MOLLE) attachment. The kit 1000 may further include one or more straps 1090 to secure the case 1002 to a backpack or the like.

Standard-issue or off-the-shelf gun cleaning kits include a wide variety of cleaning tools and implements to accommodate as many types of guns as possible. For example, a manufacturer may offer a military gun cleaning kit that is compact, lightweight, and is designed to clean and maintain all 5.56 MM, 7.62 MM, 9 MM, .40 caliber, .45 caliber, .50 caliber, and 12 gauge weapon systems. By serving the needs of many different types of gun owners with a single product offering, the manufacturer of the gun cleaning kit is able to utilize economies of scale and keep manufacturing costs low. In turn, the retail price for the cleaning kit is quite affordable. However, a one-kit-fits-all approach inevitably results in some of the implements going unused. In a compact kit, unused implements occupy valuable space that may otherwise be used for other useful implements.

To this end, gun cleaning kit manufacturers have offered products that are tailored to a specific class of firearms, such as 5.56 MM military variants. A cleaning kit for this class may be specifically designed to clean the C7, C8, M16, M249 SAW, M4, Mod 46, and HK 416 firearms, for example. Although a cleaning kit designed for a class of firearms can be useful and may be advantageous for certain applications, it suffers from drawbacks. For example, the kit may not include implements to clean and scrape hard to reach places such as the locking lugs, the slides, the bolt face, and rails. Or, the kit may not include implements to clean and maintain the optical gunsights.

A growing percentage of current military weapons include advanced optical gunsights. For example, the M16 rifle and M4 carbine are often outfitted with a M68 Close Combat Optic (CCO), a red dot laser sight mounted on the tactical rail. Designed for use at close quarters of less than 100 yards, the M68 is a non-magnified, both-eyes-open aiming solution which provides rapid target acquisition and allows accurate aiming in low-light conditions. For long-range sighting, the M16 and M4 may be outfitted with the Advanced Combat Optical Gunsight (ACOG), a telescopic sight that provides fixed power magnification levels from 1.5× to 16×, depending on model. Additionally, the M240 machine gun, or squad automatic weapon (SAW) in wide usage by infantry soldiers, may be outfitted with a M145 Machine Gun Optic, which is a small arms scope of 3.4× magnification mounted on the tactical rail.

All of the above-described optical gunsights, as well as infrared night vision equipment, rangefinders, binoculars, cameras, and eyewear perform best when cleaned of dust, fingerprints, dirt, and water spots. Therefore, a gun cleaning kit ideally should include implements that provide quick and accurate cleaning while protecting the delicate optical surfaces. Some gun cleaning kit manufacturers offer additional cleaning kits for optics, but these kits must be carried separately, often occupying valuable space on the MOLLE attachment. Some gun cleaning kits include optics cleaners stored within the kit case, but due to space limitations the optics cleaners may not be optimized for the particular optics being used.

In addition to cleaning optics, the exterior surfaces of a firearm may need periodic cleaning. For example, in geographic locations that are prone to environmental sand and dust, firearm owners must periodically wipe down the exterior surfaces of their firearms to prevent the fine-grain sand and dust from interfering with the firearm's internal components. A common implement used for this purpose is a 3-inch stiff bristle paint brush. Although a household paint brush can be useful for exterior cleaning, the brush is too large to fit within the interior of most cleaning kits and therefore must be carried separately. Any implement carried separately is prone to being lost or forgotten.

As can be appreciated, as firearm accessories become more specialized and the geographical field of operation becomes more specific, a gun cleaning kit may require a large number of specific cleaning implements for optimum care. However, manufacturing and carrying inventory on a large number of model-specific gun cleaning kits is less economical and therefore increases the retail price, and in some markets the price increase is prohibitively expensive.

To address this dilemma, the inventor of the present disclosure has devised a modular gun cleaning kit that attaches to a base cleaning kit. The base cleaning kit may provide standard cleaning implements, and the modular attachment may provide storage for specialized cleaning implements. For example, the cleaning implements in the modular attachment may be adapted for specific firearms, specific firearm accessories such as optics, specific geographical or climatological environments, or specific missions. In this manner, any number of specialized, modular cleaning kits may be provided with common attachment features to the base cleaning kit case.

Figure 7:
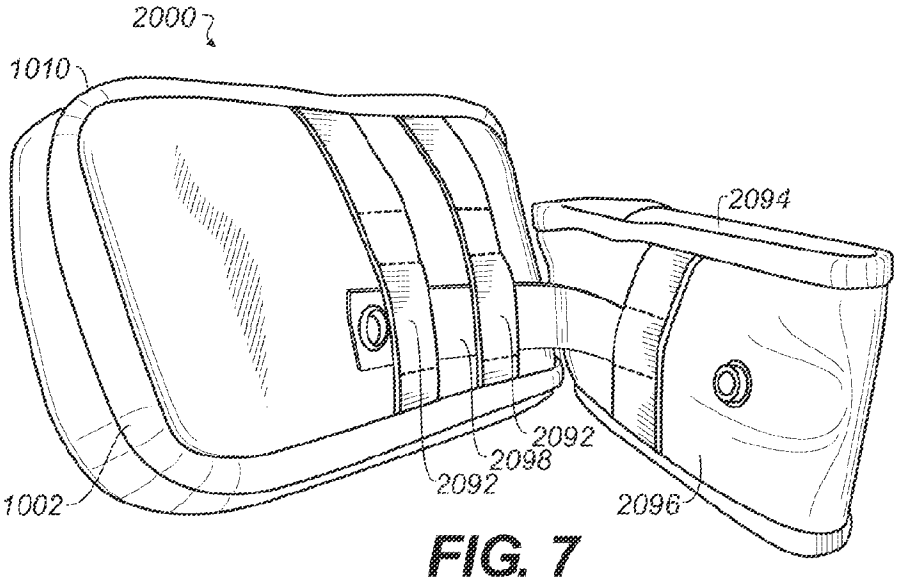
FIG. 7 is a perspective exterior view of a firearm cleaning kit case and a modular kit case according to one embodiment of the invention.

Referring now to FIG. 7, a firearm cleaning kit 2000 includes a case 1002 such as that disclosed in FIGS. 1-6 and a module attachment element 2092 affixed to an exterior portion thereof (opposite belt attachment 1088, FIG. 6) to secure one or more modular kit cases 2094. The module attachment element 2092 is designed for rapid, reliable attachment and detachment of the modular kit case 2094. A modular, detachable kit is very important to a military team, for example, because a team may have several weapons at their disposal, but may only select one rifle and one side arm for a particular mission. In some applications, such as military usage, the module attachment element 2092 is designed for quiet operation so as to not attract attention during attachment and detachment. In the illustrated embodiment, the module attachment element 2092 comprises two loops of heavy-weight fabric, one spaced about 1 inch vertically from the other. Each loop is formed by positioning a strap of material horizontally relative to the case 1002, and sewing each end of the strap to the case 1002. As can be seen with reference to FIG. 7, a sufficiently wide case 1002 may accommodate two (or more) module attachment elements 2092 so as to allow more than one modular kit case 2094 to be secured to the case.

The modular kit case 2094 may be formed of fabric or hard-shell, and includes a backing portion 2096 with an external fastening element 2098 adapted for securement with the module attachment element 2092 of the case 2002. In the disclosed embodiment, the fastening element 2098 includes a strap of stiff fabric sewn to the backing portion 2096. The stiff strap may be quickly and accurately inserted through the two loops of the module attachment element 2092, then snapped into place as illustrated. Other examples of securement are contemplated without departing from the scope of the invention, but a design factor may be that the attachment and detachment operate quietly. Therefore, in some applications, hook and loop fasteners are not desirable.

Figure 8:
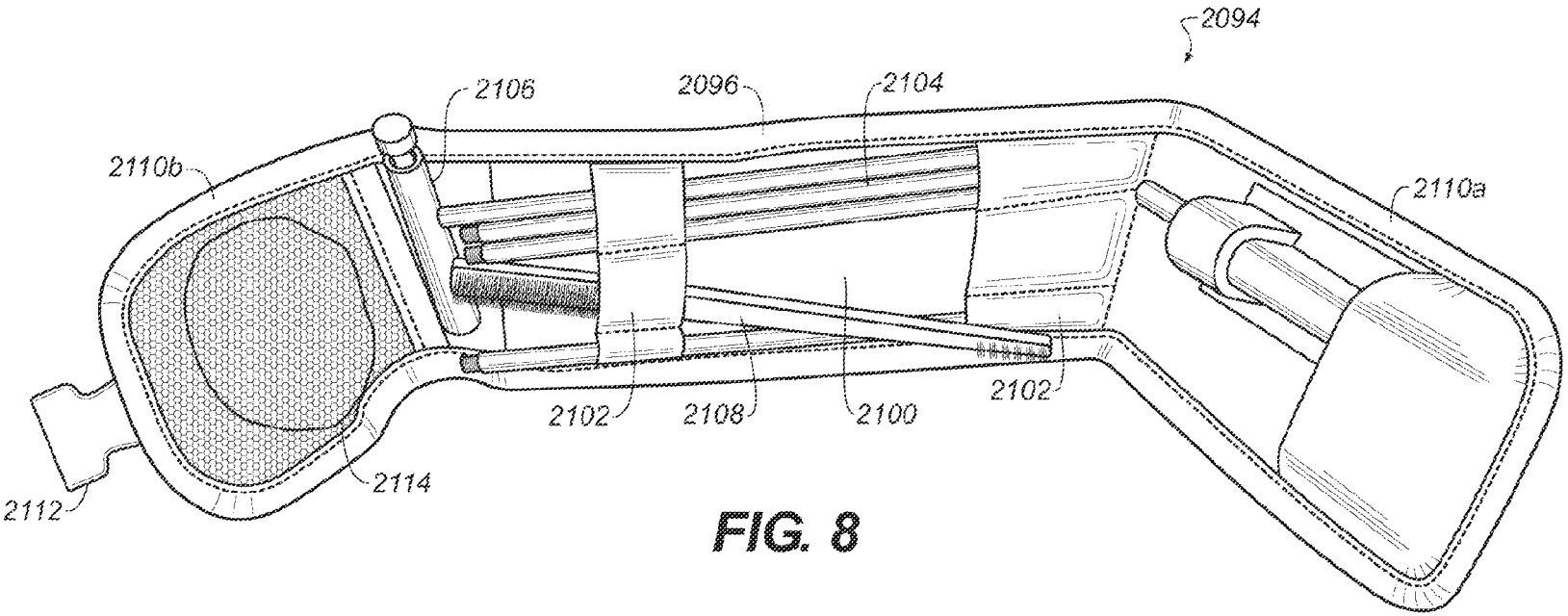
FIG. 8 is a perspective interior view of the modular kit case shown in FIG. 7.

Referring to FIG. 8, shown is an inside storage area 2100 of the backing portion 2096 configured to store specialized cleaning implements that otherwise may not be included or may not fit into the base firearm cleaning kit. In one embodiment, the inside storage area 2100 includes an elastic strap 2102 sewn to the inside surface of the backing portion 2096 at both ends and at least one location in the middle to provide a plurality of tool holding cavities. As illustrated, a second elastic strap is sewn in like manner across the base of the backing portion 2096 to form elasticized pockets. The particular configuration of tool holding cavities shown is suitable for storing implements to clean an M16 or M4 firearm. Specifically, a plurality of metal rod segments 2104 having internal threads on one end and external threads on an opposing end may be threaded together along with a metal foldable T-handle segment 2106 to form a metal cleaning rod of sufficient length to clean the long internal barrel of the M16 or M4. Also included in the inside storage area 2100 is a double-headed receiver brush 2108, the bristles of which may be nylon or bronze, for example.

The modular kit case 2094 further includes a protective cover 2110 to protect the cleaning implements stored within the inside storage area 2100. In one embodiment, the protective cover 2110 comprises a tri-fold flap. That is, a first flap 2110*a* joined at the base of the backing portion 2096 folds upwards, and a second flap 2110*b* joined at the top of the backing portion 2096 folds downwards and overlaps the first flap 2110*a*. A cover attachment 2112, such as a side release buckle, secures the first flap 2110*a* to the second flap 2110*b*. Additional implement storage space may be utilized on the inside portions of the protective cover 2110. For example, the inside of the second flap 2110*b* may include a pouch 2114 for storing cleaning patches.

Figure 9:
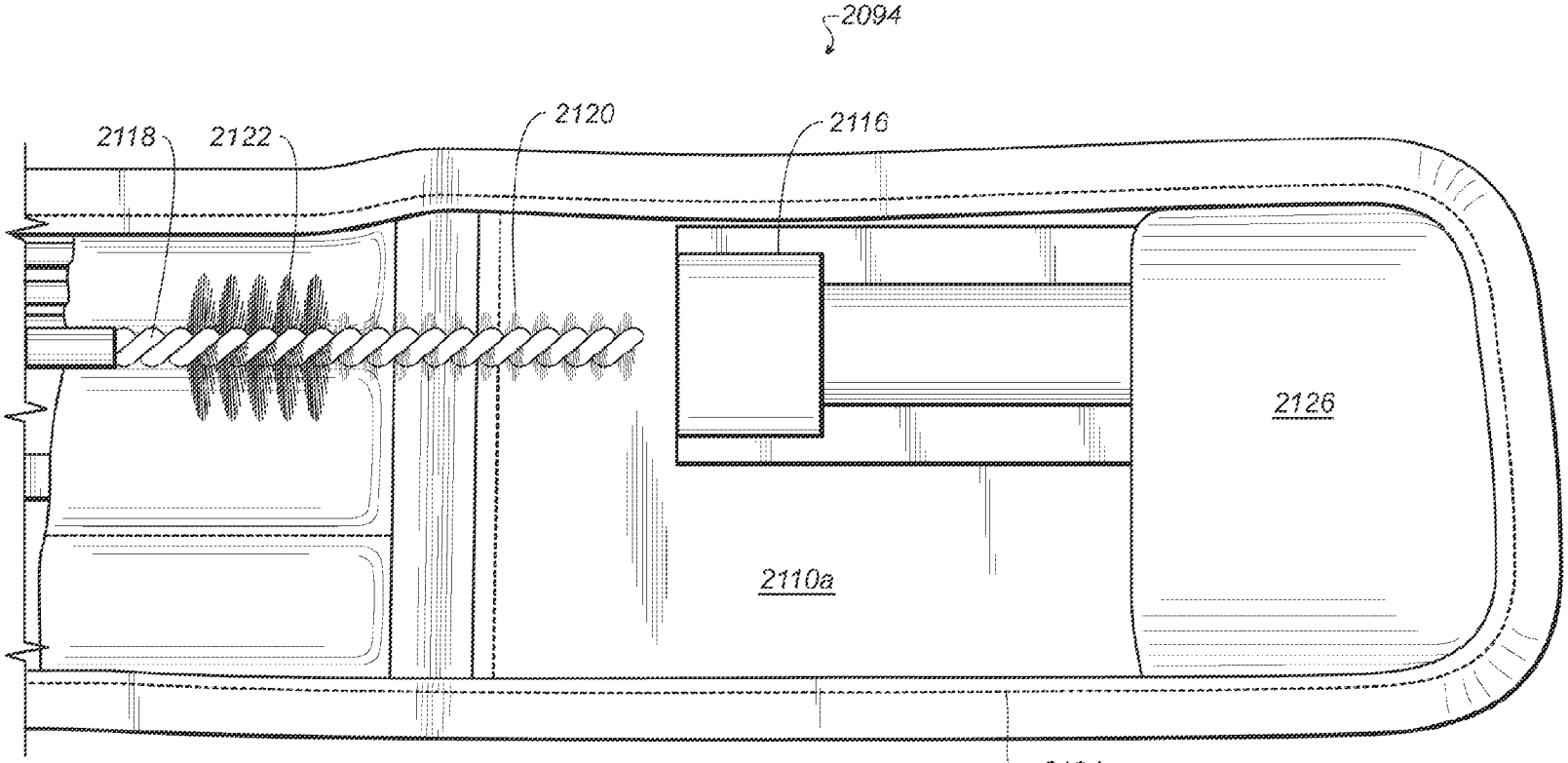
FIG. 9 is a perspective view of a protective shell shown in FIG. 8 according to one embodiment of the invention.

Turning to FIG. 9, in one embodiment of the invention the modular kit case 2094 includes an implement protective shell 2116 to enclose and protect cleaning implements from damage. The protective shell 2116 may be fixed to the case 2094 or, as illustrated, may be fixed to the inside portion of the first flap 2110*a*. The protective shell 2116 is especially useful in protecting the wire-bristle portion of chamber and bore cleaning brushes, or in protecting the fine threads of cleaning implements that are threadably attached to a fixed rod or flexible cable. Protection of the chamber and bore brushes is very important to the military as their gear is often subjected to heavier load and extreme forces. The protective shell 2116 may be formed of hardened plastic, hardened rubber, or soft rubber, for example. The protective shell 2116 is adapted to secure the cleaning implement by a slight friction fit. In this manner, the cleaning implement may be snugly held in place to prevent the tool from falling out of the modular kit case 2094, yet may be removed without excessive force or damage to the tool. Prior art protective cases for bore or chamber cleaning brushes, such as a bottle with cap, had to be removed from the case to access and utilize the brush in a cleaning operation. By securing the protective shell 2116 to the case, the potential for losing the protective case (or the case and brush together) is eliminated.

One illustrative example of an implement protective shell 2116 is shown in FIG. 9. As depicted, the protective shell 2116 is realized on the inside portion of the first flap 2110*a*, but the shell may be located at any convenient location. The protective shell 2116 surrounds a chamber brush 2118 which, in the illustrated example, includes tapered bronze bristles 2120 at a first diameter to scrub the chamber, neck and shoulder of a firearm (not shown), and steel bristles 2122 at the base at a second diameter to scrub the star chamber of the locking lugs (also not shown). The protective shell 2116 is sized to secure at least one of the diameters by friction fit, for example the larger diameter steel bristles 2122. In this manner, the chamber brush 2118 is secured within the protective shell 2116, but the wire bristles 2120, 2122 will not suffer deformation or damage from storage.

The protective shell 2116 may be secured to a mounting board 2124 that provides support for the protective shell and cleaning implement stored therein. The mounting board 2124 may be formed of a stiff yet flexible polymeric material, for example, to provide a small degree of flexibility. In other examples, the mounting board 2124 may be formed of a hardened material.

Figure 10:
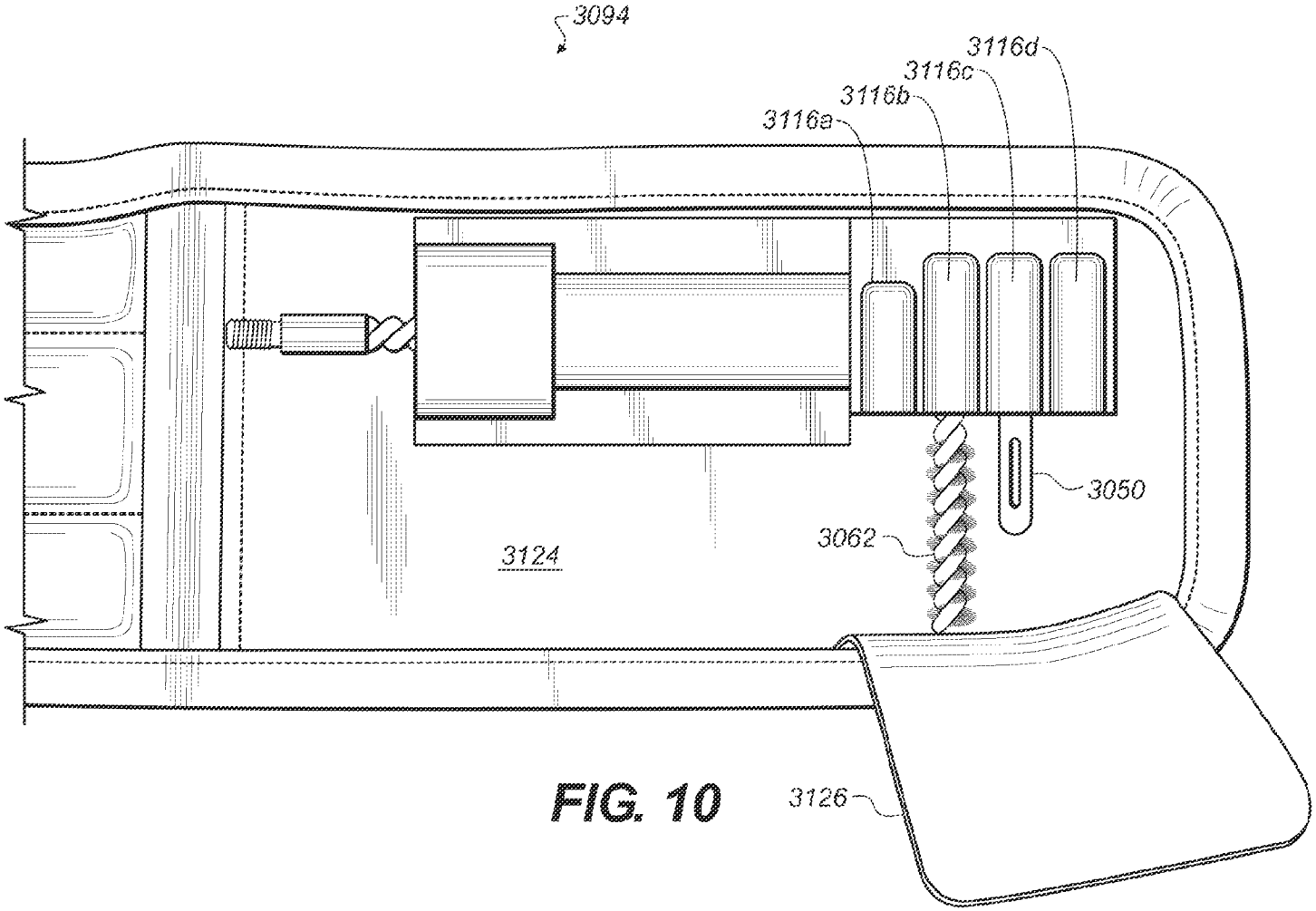
FIG. 10 is a perspective view of a protective shell shown in FIG. 8 according to another embodiment of the invention.

Another illustrative example of an implement protective shell 3116 is shown in FIG. 10. As shown, a plurality of protective shells 3116*a*-3116*d* surround and secure the threaded or base portions of various cleaning implements. Shown for illustrative purposes are a bore cleaning brush 3062 and a slotted tip 3050 for holding cleaning patches. The protective shells 3116*a*-3116*d* are sized to secure the base portions by friction fit such that the cleaning implements may be snugly held in place to prevent the tools from falling out of the modular kit case 3094, yet may be removed without excessive force or damage to the tools.

The protective shell 3116 secures and protects the base portion of a cleaning implement, but may expose the top portion to potential damage. Therefore, in some embodiments, the modular kit case 3094 may include a flexible flap 3126 for protecting the exposed portion of the cleaning implement. The flap 3126 may be formed of a thin, fiber-reinforced rubber compound, for example, to withstand wear and tear over time. The flap 3126 may be secured on one end to the side of the modular kit case 3094, or to the mounting board 3124, if present.

Figure 11:
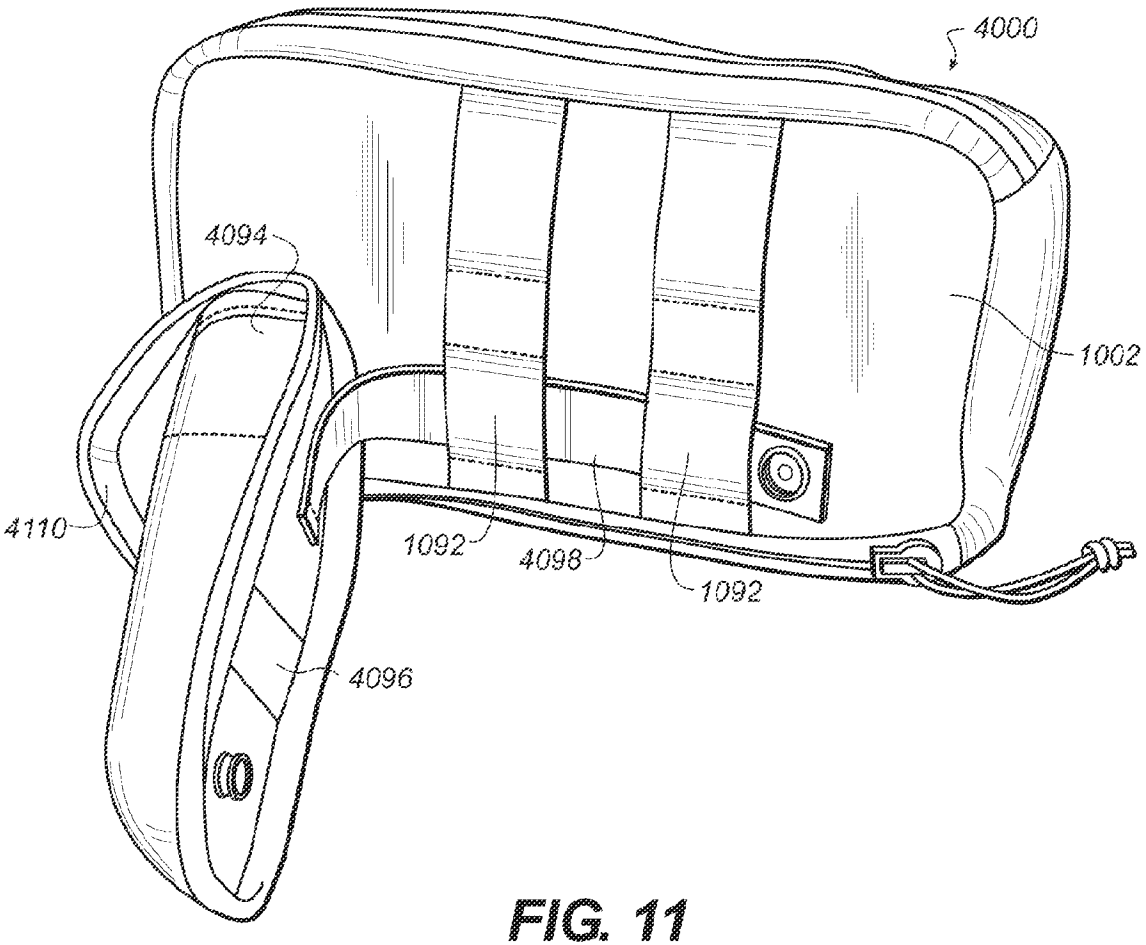
FIG. 11 is a perspective exterior view of a firearm cleaning kit case and a modular kit case according to another embodiment of the invention.

Turning to FIG. 11, in another embodiment a firearm cleaning kit 4000 includes a case 1002 such as that disclosed in FIGS. 1-6 and a modular kit case 4094 that is smaller and lighter than the modular kit case 2094 illustrated with respect to FIG. 7. The smaller-sized kit case 4094 may be better suited for carrying a fewer number of specialized cleaning implements, or for allowing multiple modular kit cases to be attached to the base case 1002. The modular kit case 4094 includes a backing portion 4096 to which is secured a common external fastening element 4098 adapted for securement with the module attachment element 1092 of the case 1002. Thus, the modular kit case 4094 is fully interchangeable with the modular kit case 1094. The modular kit case 4094 includes a protective cover 4110 comprising a flap joined at the top of the backing portion 4096.

Figure 12:
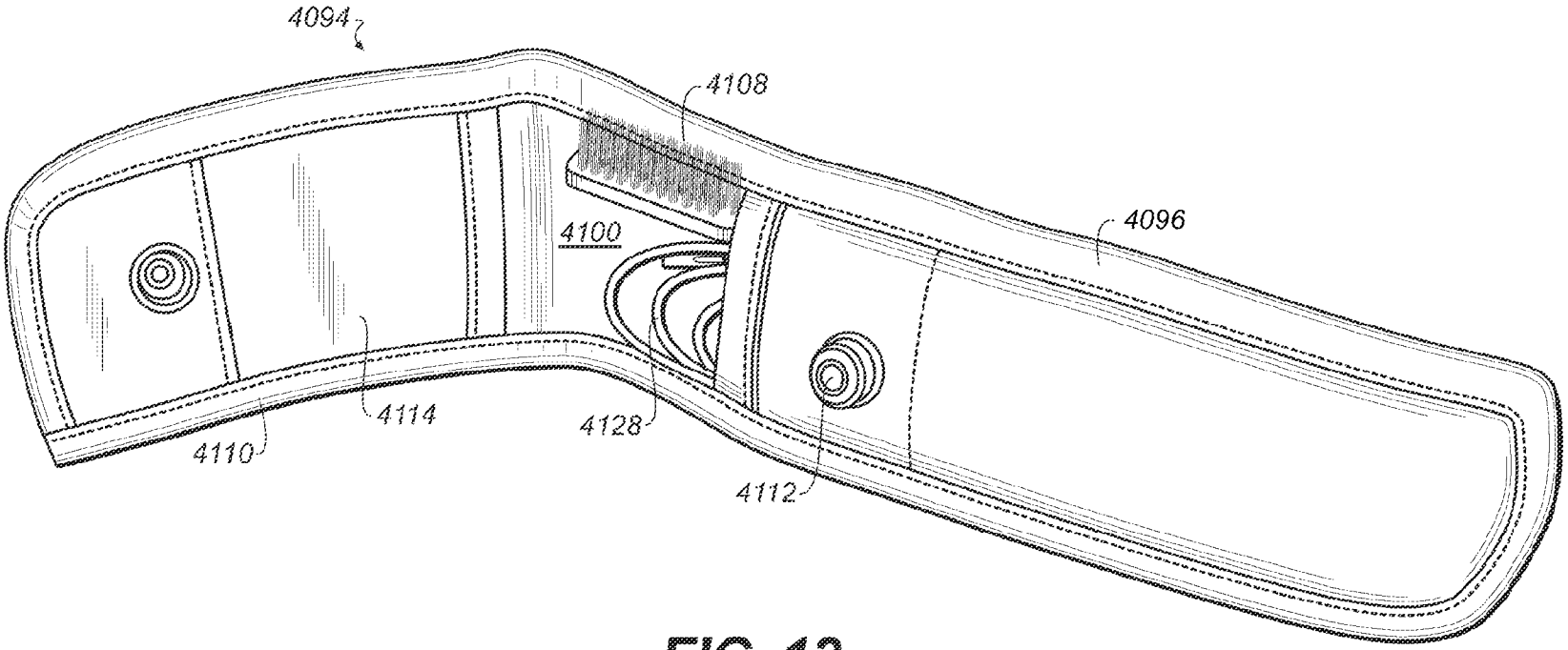
FIG. 12 is a perspective interior view of the modular kit case shown in FIG. 11.

Turning to FIG. 12, the modular kit case 4094 is shown in further detail. An inside storage area 4100 of the backing portion 4096 may include longer, thinner implements such as a flexible cable cleaning rod 4128 or receiver brush 4108. The modular kit case 4094 includes a protective cover attachment 4112 comprising a snap, in contrast to the side release buckle on the modular kit case 1094 disclosed above. The modular kit case 4094 may further include a pouch 4114 for storing cleaning patches, for example.

Figure 13:
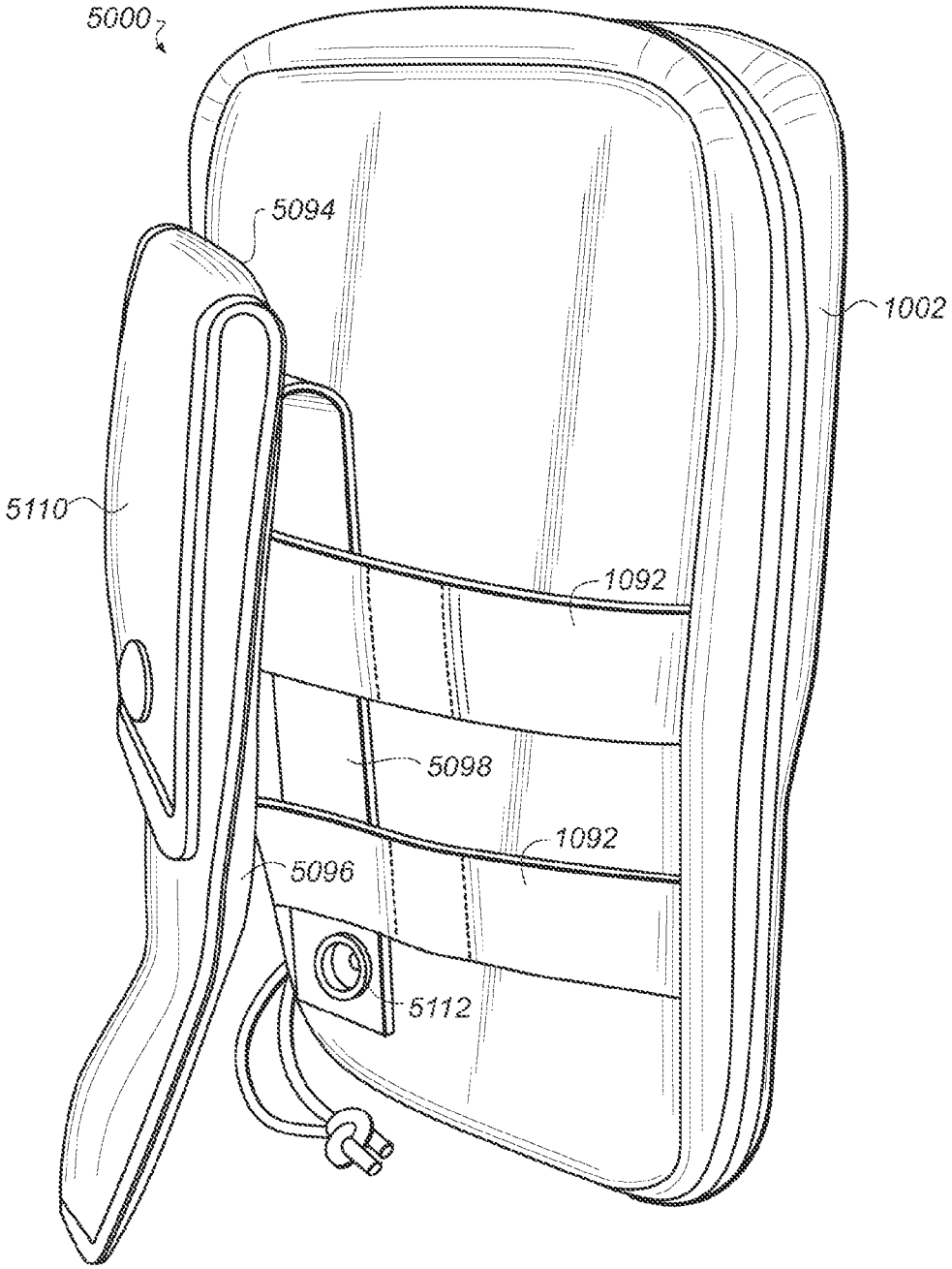
FIG. 13 is a perspective exterior view of a firearm cleaning kit case and a modular kit case according to yet another embodiment of the invention.

Turning to FIG. 13, in another embodiment a firearm cleaning kit 5000 includes a case 1002 such as that disclosed in FIGS. 1-6 and a modular kit case 5094 that is even smaller and lighter than the previously disclosed modular kit cases. The kit 5094 is ideally suited for allowing multiple modular kit cases to be attached to the base case 1002. The modular kit case 5094 includes a backing portion 5096 to which is secured a common external fastening element 5098 adapted for securement with the module attachment element 1092 of the case 1002. Thus, the modular kit case 5094 is fully interchangeable with the modular kit cases 2094 and 3094, and may even be attached to the case 1002 in addition to them. The modular kit case 5094 includes a protective cover 5110 comprising a flap joined at the top of the backing portion 5096.

Figure 14:
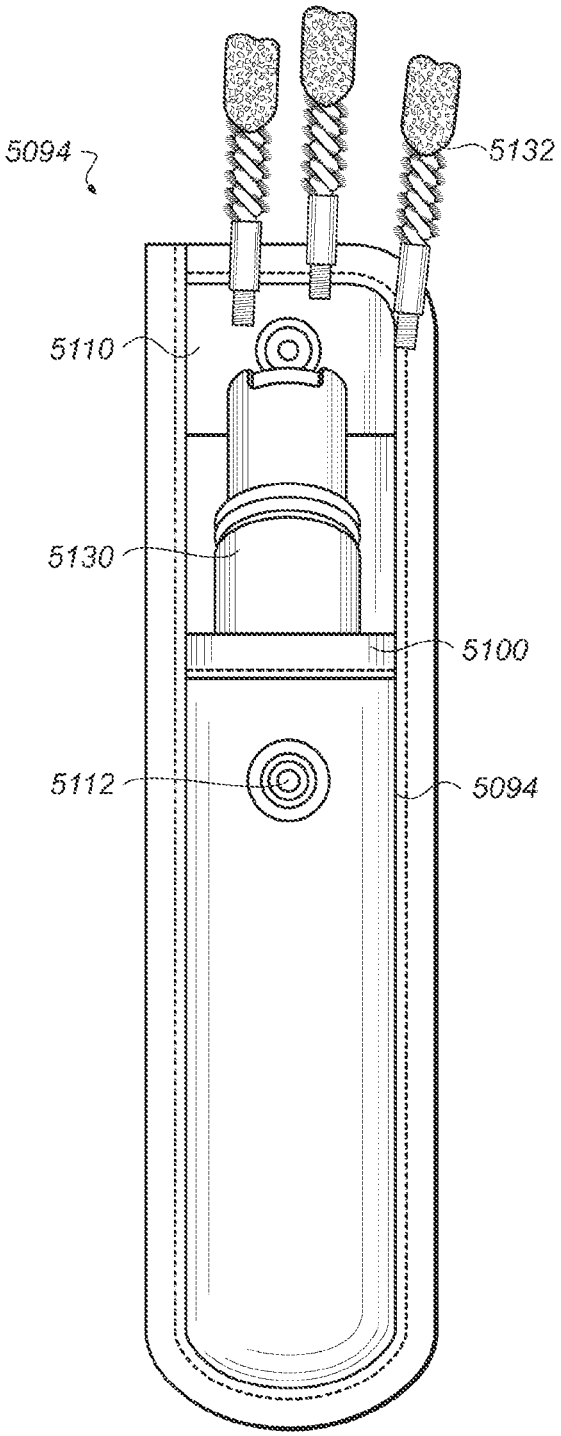
FIG. 14 is a perspective interior view of the modular kit case shown in FIG. 13.

Turning to FIG. 14, the modular kit case 5094 is shown in further detail. An inside storage area 5100 of the backing portion 5096 is quite small, and is ideally suited for storing small cleaning implements such as a bottle of optical cleaning fluid 5130 or integrated dual-technology (IDT) brushes 5132, for example. The modular kit case 5094 similarly includes a protective cover attachment 5112 comprising a snap. Note that the modular kit case 5094 is too small to include a pouch.

Figure 15:
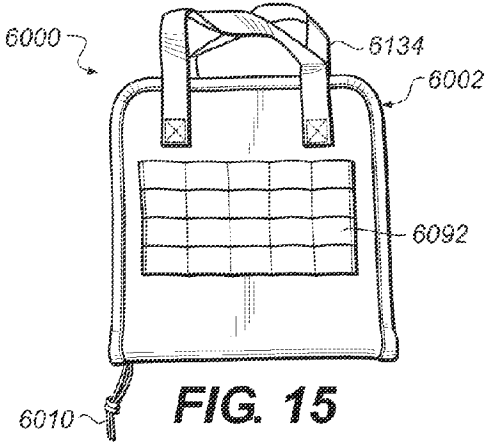
FIG. 15 is a front plan view of a firearm cleaning kit according to another embodiment of the invention.

FIG. 15 depicts a firearm cleaning kit 6000 according to another embodiment of the invention. The kit 6000 includes a field case 6002 that is larger in size than the case 1002 depicted in FIGS. 1-6. The field case 6002 may be suitable for use as a squad or team kit rather than an individual kit. In one example, the case 6002 measures approximately 24 cm square. The case may be formed of any of the materials disclosed with respect to case 1002, for example nylon. The case 6002 may include carrying handles 6134 to facilitate transport. The case 6002 may be of the clamshell variety having a fastener 6010 (e.g., a zipper) securing the case along three sides. The cleaning kit 6000 includes a module attachment element 6092 affixed to an exterior side of the case 6002 for rapid, reliable attachment and detachment of a modular kit case. In the illustrated embodiment, the module attachment element 6092 is adapted for MOLLE attachment.

Figure 16:
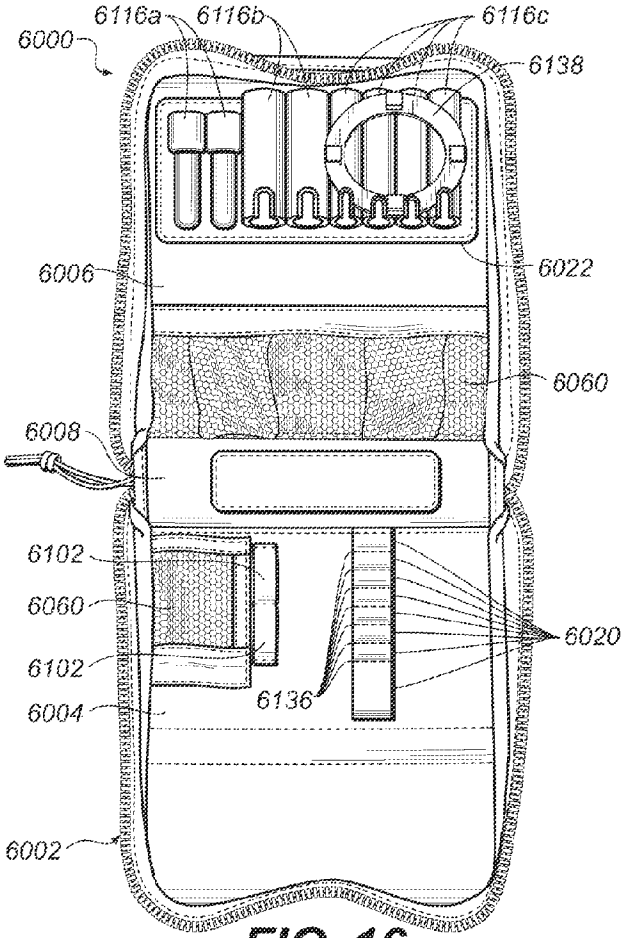
FIG. 16 is a plan view of the interior of the firearm cleaning kit shown in FIG. 15.

FIG. 16 depicts an interior view of the firearm cleaning kit 6000 in the open position. The case 6002 includes a first side 6004 and a second side 6006 separated by a fold line 6008. The fold line 6008 joins the first side 6004 to the second side 6006, allowing the two to be folded up in a clamshell-type arrangement. As noted, the larger case 6002 permits storage of a large number of cleaning implements for a wide variety of weapons, such as 5.56 MM, 7.62 MM, 9 MM, 40 MM, .40 cal., .45 cal., .50 cal., and 12 gauge weapons. In one example, the cleaning kit 6000 permits storage of over 40 firearm-specific cleaning components. The first side 6004 of case 6002 may include a nylon mesh pocket 6060 to store cleaning patches, for example, and may further include one or more elastic straps 6102 to secure cleaning fluid, as another example. The case 6002 may further include storage compartments 6020, which may be fixed or adjustable. In the illustrated embodiment, the storage compartments 6020 are fixed; that is, a single elastic strap is sewn to the case 6002, and enough slack is left between the stitching 6136 to form the compartment 6020. The compartments 6020 may also be variable, as described in reference to FIG. 1. Various implements can be secured in the compartments 6020, such as vials to store specialized precision tools for complete breakdown and fine cleaning of all critical and hard to reach areas of the weapon, or optics cleaning implements for care and maintenance of scopes, rangefinders, and night vision equipment.

The second side 6006 of case 6002 may include additional nylon mesh pockets 6060, and a tool-holding insert 6022. In the illustrated embodiment, the insert 6022 is permanently secured to the interior of the case 6002 (e.g., stitched), but the insert 6022 could also be secured by an attachment element, such as that described with reference to FIG. 5. The tool-holding insert 6022 includes numerous implement protective shells 6116 to enclose and protect cleaning implements from damage. The protective shells 6116 are fixed to the case 6002 in the illustrated example. The protective shells 6116 are especially useful in protecting the wire-bristle portion of chamber and bore cleaning brushes, or in protecting the fine threads of cleaning implements that are threadably attached to a fixed rod or flexible cable. The protective shell 6116 may be formed of hardened plastic, hardened rubber, or soft rubber, for example. The protective shell 6116 is adapted to secure the cleaning implement by a slight friction fit. In this manner, the cleaning implement may be snugly held in place to prevent the tool from falling out of the case 6002, yet may be removed without excessive force or damage to the tool. In the illustrated embodiment, protective shell **6116*a* is adapted to secure a chamber brush (e.g., chamber brush 2118 in FIG. 9); protective shell 6116*b* is adapted to secure a 12 gauge bore brush; and protective shell 6116*c*** is adapted to secure a .50 caliber bore brush. The depicted embodiments are illustrative, and not intended to be limiting.

Figure 18:
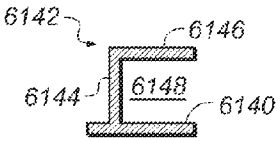
FIG. 18 is a cross-sectional view through a capture element shown in FIG. 17.
Figure 17:
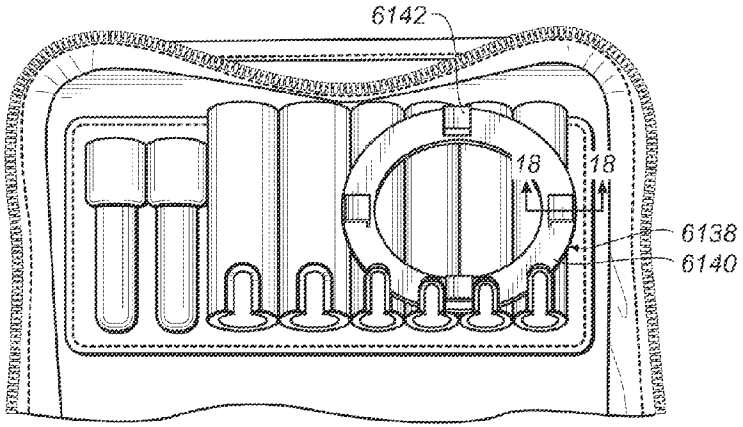
FIG. 17 is a magnified view of the interior shown in FIG. 16.

One noted problem with some firearm cleaning kits is that the flexible cable cleaning rod, such as that depicted in FIG. 12, unravels easily and can dislodge from the storage pocket. When the kit or case is opened, the flexible cable can spring outward and fall out of the case. To alleviate this problem, the firearm cleaning kit 6000 may further include a cable reel 6138 to store flexible cable cleaning rods, such as Memory-Flex® cleaning rods sold by Otis Technology, Lyons Falls, N.Y. and depicted as element 4128 in FIG. 12. In one embodiment, shown enlarged in FIG. 17, the cable reel 6138 includes a circular or semi-circular flat base 6140 on which the coiled cable rests. The cable reel 6138 further includes a plurality of capture elements 6142 disposed around the outer perimeter of the base 6140. In one example, depicted in cross section in FIG. 18, the capture element 6142 comprises a back spine 6144 extending transversely from the base 6140, and a cap portion 6146 extending transversely from the spine 6144, thereby defining a capture cavity 6148. One end of the flexible cable cleaning rod can be secured within the capture cavity 6148 of a capture element 6142, and the remainder of the cable can be wound about the base 6140, assuring each loop of cable is secured within the capture cavity 6148 of each capture element 6142. The flexible cable has a strong tendency to unravel, and the spine portion 6144 will restrain the cable from unraveling, and the cap portion 6146 will restrain the cable against the base 6140. The cable reel 6138 provides compact, orderly management and storage of the flexible cable cleaning rod.

In one embodiment of the present invention, the cable reel 6138 is formed integrally with the tool-holding insert 6022. As noted, the insert 6022 can be formed of molded plastic or the like, and the cable reel 6138 can be molded integrally to the insert 6022.

Figure 19:
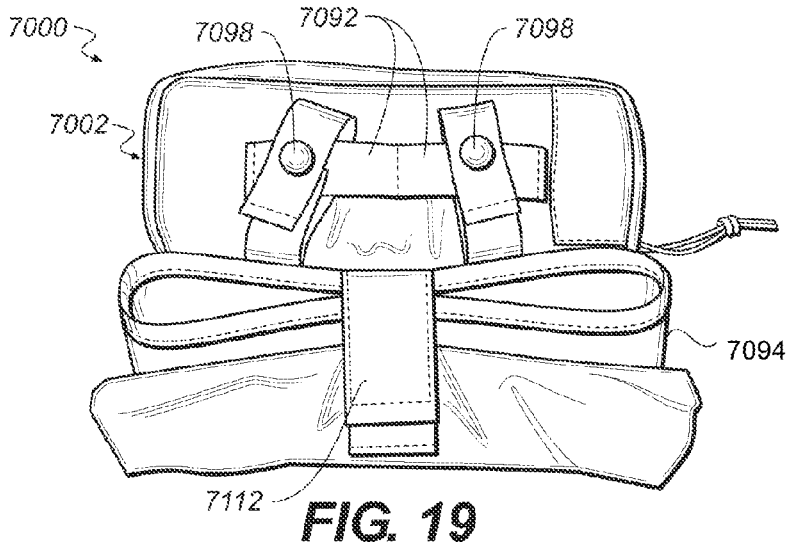
FIG. 19 is a plan view of a modular kit case in a stowed position according to yet another embodiment of the invention.

Turning now to FIG. 19, shown is a firearm cleaning kit 7000 according to another embodiment of the invention. The kit 7000 includes a case 7002 and a modular kit case comprising a drop pouch 7094, shown in a rolled-up, stowed position. The case 7002 includes a module attachment element 7092 affixed to an exterior portion thereof to secure one or more modular kit cases. In the illustrated embodiment, the module attachment element 7092 comprises two loops of heavy-weight fabric spaced side by side. Each loop is formed by positioning a strap of material across the case 7002, and sewing each end of the strap to the case 7002. As can be seen with reference to FIG. 19, a sufficiently wide case 7002 may accommodate two (or more) module attachment elements 7092 so as to allow more than one modular kit case 7094 to be secured to the case. In the illustrated embodiment however, a single, wide modular kit case in the form of a drop pouch 7094 is releasably secured to the module attachment element 7092. The drop pouch 7094 includes an attachment 7112 to secure the pouch in a rolled up configuration. In one embodiment, the attachment 7112 is a hook and loop fastening system. The drop pouch 7094 further includes two fastening elements 7098 adapted for securement with the module attachment element 7092 of the case 7002. In the disclosed embodiment, the fastening elements 7098 are snaps, but could also comprise hook and loop fasteners, or MOLLE attachments, for example. Note that the fastening elements 7098 could secure to a case, as shown, or also to another suitably adapted modular kit case. In this manner, many different styles of modular kit cases can secured to the case, depending upon the particular mission requirements. For example, any of the disclosed modular kit cases 2094, 3094, 4094, 5094, 7094 can be secured separately or in combinations with the cases 1002, 6002, 7002.

Figure 20:
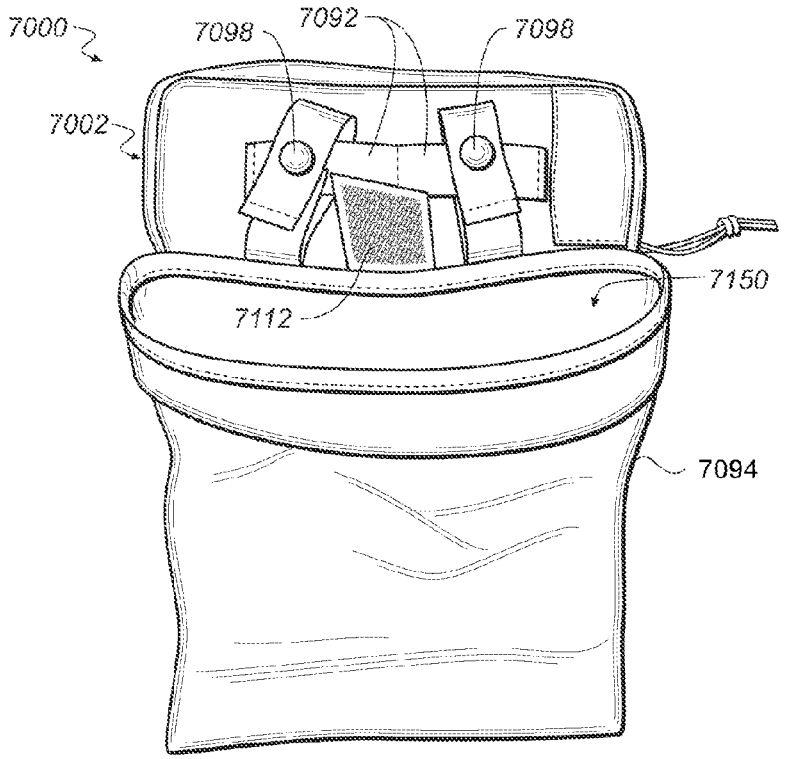
FIG. 20 is a plan view of the modular kit case of FIG. 18 out of the stowed position.

FIG. 20 depicts the drop pouch 7094 in the extended position. Upon releasing the attachment 7112, the pouch 7094 unfurls to expose a large-mouth opening 7150, making the drop pouch 7094 suitable for carrying large objects, especially spent ammunition magazines. Note that the pouch 7094 is still fastened to the case 7002, even when open. The drop pouch may include a drawstring closure with cord lock (not shown) to cinch the pouch closed when not in use, and a drain hole grommet (also not shown) to provide quick drainage.

One of the advantages of the firearm cleaning kit disclosed herein is that a base cleaning kit may be combined with a specialized, modular cleaning kit. The base cleaning kit may be a standard-issue or off-the-shelf cleaning kit, and the modular kit may comprise personalized implements, specialized implements, or both. The modular kit may be quickly exchanged for other modular cleaning kits that attach to the same base cleaning kit. In this manner, the user may swap out modular elements depending on a particular mission or weapon. This is particularly advantageous in a military environment, wherein an infantry squad (for example) may have a number of specialized weapons available to its soldiers. Specialized, modular cleaning kits may be assembled in advance and simply attached to the base cleaning kit for whichever soldier is using the specialized weapon or accessory, thereby saving mission preparation time. Allowing unique customization without having to carry two or more full cleaning kits decreases the overall weight of the cleaning kit. Minimizing weight is an important factor for soldiers tasked with patrol operations, since they must pack and carry a three-day supply of food, ammo, etc.

The above-described features and advantages are not limited to military use. Hunters and law enforcement officers may also benefit from a specialized, modular cleaning kit that attaches to a standard kit. Allowing unique customization without having to carry two or more full cleaning kits simplifies preparation and reduces the risk of losing or forgetting implements.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

What is claimed is:

1. A firearm cleaning kit comprising:

a case comprising a first side and a second side joined along a fold line;

a fastener for joining together the first and second side of the case;

a first firearm cleaning implement of at least one or more firearm cleaning implements;

a coiled flexible cable cleaning rod;

a tool-holding insert secured to an interior region of the case, the tool-holding insert comprising a plurality of implement protective shells to hold said first firearm cleaning implement; and a cable reel to store said coiled flexible cable cleaning rod.

2. The firearm cleaning kit according to claim 1, wherein the cable reel comprises a molded plastic.

3. The firearm cleaning kit according to claim 1, wherein the cable reel comprises a circular flat base on which the coiled flexible cable cleaning rod rests.

4. The firearm cleaning kit according to claim 1, wherein the cable reel comprises a plurality of capture elements disposed around an outer perimeter of a circular flat base.

5. The firearm cleaning kit according to claim 4, wherein each capture element of said plurality of capture elements comprises a capture cavity to secure the coiled flexible cable cleaning rod.

6. The firearm cleaning kit according to claim 5, wherein each capture element comprises a back spine extending transversely from the circular flat base, and a cap portion extending transversely from said back spine.

7. The firearm cleaning kit according to claim 6, wherein said back spine restrains the coiled flexible cable cleaning rod from unraveling and said cap portion restrains the coiled flexible cable cleaning rod against said circular flat base.

8. The firearm cleaning kit according to claim 1, wherein said cable reel is formed integrally with said tool-holding insert.

9. The firearm cleaning kit according to claim 1, further comprising at least one or more nylon mesh pockets disposed on at least one of an interior surface of said first side or an interior surface of said second side.

10. The firearm cleaning kit according to claim 1, further comprising at least one or more elastic straps disposed on at least one of an interior surface of said first side or an interior surface of said second side.

11. The firearm cleaning kit according to claim 1, further comprising at least one or more carrying handles.

12. The firearm cleaning kit according to claim 1, wherein said case comprises a clamshell wherein said fastener fastens the case along three sides.

13. The firearm cleaning kit according to claim 1, wherein said fastener comprises a zipper.

* * * * *